United States Patent [19]

Lekavich

[11] Patent Number: 4,682,762

[45] Date of Patent: Jul. 28, 1987

[54] FENCE SYSTEM WITH ONE-PIECE POSTS

[76] Inventor: Carl W. Lekavich, 1645-3 W. Sepulveda, Torrance, Calif. 90501

[21] Appl. No.: 601,109

[22] Filed: Apr. 18, 1984

Related U.S. Application Data

[63] Continuation-in-part of Ser. No. 495,438, May 17, 1983, abandoned.

[51] Int. Cl.[4] ..... E04H 17/14

[52] U.S. Cl. ..... 256/65; 403/347; 403/209

[58] Field of Search ..... 256/65, 21; 403/347, 403/209, 212; 29/439, 505

[56] References Cited

U.S. PATENT DOCUMENTS

| | | | |
|---|---|---|---|
| 2,950,015 | 8/1960 | Pataky | 256/65 X |
| 3,285,576 | 11/1966 | Clark | 256/65 X |
| 3,486,739 | 12/1969 | Nelson | 256/65 |
| 3,719,386 | 3/1973 | Burton | 403/347 X |
| 4,037,788 | 7/1977 | Riley | 256/65 X |

*Primary Examiner*—Andrew V. Kundrat

*Attorney, Agent, or Firm*—Christie, Parker & Hale

[57] ABSTRACT

A one-piece fence post is comprised of a rigid tubular member folded in a region between its ends to form first and second longitudinally abutting portions. A first pair of inwardly facing adjacent indentations are formed in the respective first and second portions in the region of the fold to define a transverse rail-receiving passage. One or more further pairs of inwardly facing adjacent indentations are formed in the respective first and second portions between the region and the ends of the member to define a corresponding one or more additional transverse rail-receiving passages. The first and second portions are joined together, as for example, by welding, preferably between each pair of rail-receiving passages. The posts are preferably made of metal, such as galvanized steel pipe, in which case they can be inexpensively fabricated by known metal-working techniques.

35 Claims, 15 Drawing Figures

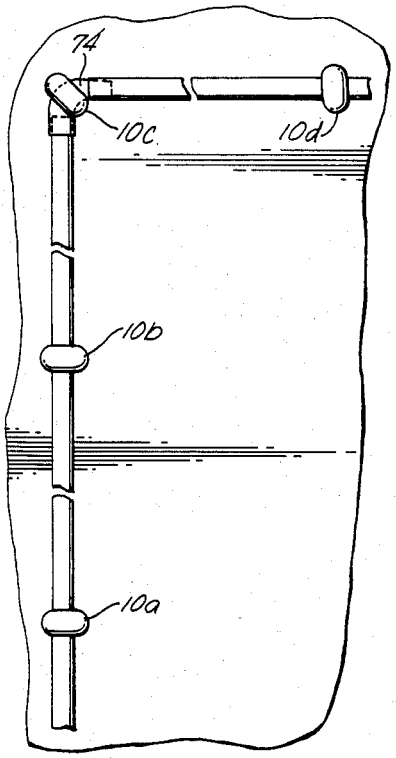
Fig. 6.
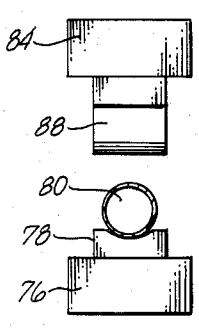
Fig. 8.
Fig. 9.
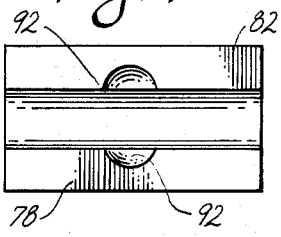
Fig. 7.
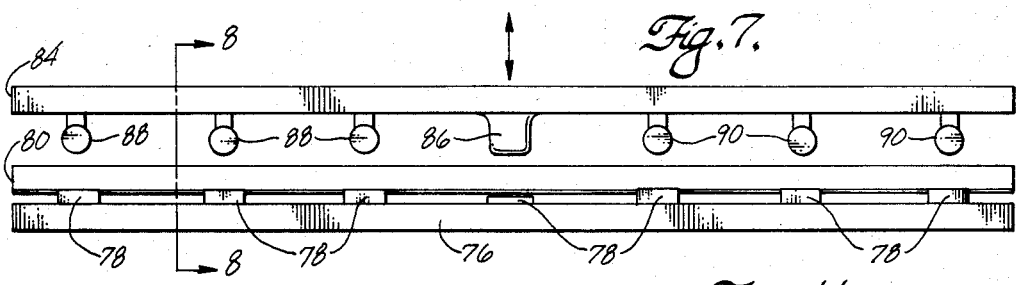
Fig. 10.
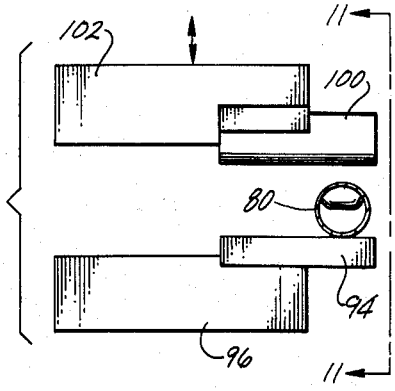
Fig. 11.
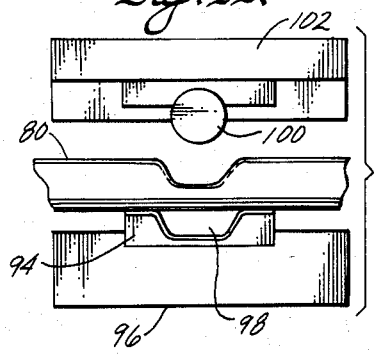

FENCE SYSTEM WITH ONE-PIECE POSTS

CROSS-REFERENCE TO RELATED APPLICATIONS

This is a continuation-in-part of application Ser. No. 495,438, filed May 17, 1983, and now abandoned.

BACKGROUND OF THE INVENTION

This invention relates to fencing and, more particularly, to a fence system with one-piece posts.

Fence systems enclose many thousands of square miles of land to confine domestic animals. Such fence systems are constructed of spaced apart vertical posts anchored in the ground and horizontal rails extending between the posts. Although the posts and rails have in the past traditionally been made of wood, metal is coming to replace wood because the former is more durable, stronger, and easier to fabricate. A post for existing metal fence systems consists of several pieces that need to be welded together on site during fence construction, which contributes significantly to the overall construction costs.

Reily U.S. Pat. No. 4,037,788 discloses a fence system having a one-piece post comprised of a rigid tubular member folded in a region between its ends to form first and second longitudinally adjacent non-abutting portions. Metal bands placed around the post hold the rails in place between the two portions of the posts against the rail, thereby securing the rails tightly therebetween. In the folded region, the posts extend appreciably above the top rail.

SUMMARY OF THE INVENTION

The invention is directed to a fence system with one-piece posts that can be readily manufactured off site by using mass production techniques. As a result, the fence system can be constructed at a substantially lower cost. The one-piece post is comprised of a rigid tubular member folded in a region between its ends to form first and second longitudinally abutting portions. A first pair of inwardly facing adjacent indentations are formed in the respective first and second portions in the folded region to define a transverse rail-receiving passage. One or more further pairs of inwardly facing adjacent indentations are formed in the respective first and second portions between the region and the ends of the member to define a corresponding one or more additional transverse rail-receiving passages. The first and second portions are joined together, as for example, by welding, preferably between each pair of rail-receiving passages.

The posts are preferably made of metal, such as galvanized steel pipe, in which case they can be inexpensively fabricated by known metal-working techniques lending themselves to mass production.

Preferably, the tubular member is cylindrical and the indentations have tubular surfaces that merge gradually into the surface of the cylindrical member so as to form generally cylindrical rail-receiving passages with oppositely disposed cusps aligned with the length of the tubular member. The rail-receiving passages have a length greater than the diameter of the tubular member. Between the posts extend cylindrical rails having a diameter adapted to fit the diameter of the passages with sufficient clearance to permit adjustment of the elevation angle of the rails when the posts are vertical. The tubular member has flattened, abutting walls in the folded region so that the post does not extend appreciably above the upper rail after installation. The horizontal rails are connected together by coupling sleeves having oppositely disposed lugs; the lugs fit into the rail-receiving passages aligned with the cusps and lock in place by interference fit when twisted toward the cylindrical surfaces of the indentations. Alternatively, the lugs could be formed near one end of each rail, if the rails are directly connected without a coupling sleeve.

A feature of the invention is a method for fabricating the described one-piece fence posts. First, a length of metal pipe is placed in a die press having a centrally located rectangular die with curved edges corresponding to the first pair of identations and a plurality of cylindrical dies corresponding to the further indentations disposed on either side of the rectangular die. When the press is closed, the indentations are formed in the length of pipe. Next, the length of pipe is bent in two about the indentations made by the rectangular die to form the rail-receiving passages. Finally, the abutting portions of the pipe are welded together between the passages to complete the post.

BRIEF DESCRIPTION OF THE DRAWINGS

The features of specific embodiments of the best mode contemplated of carrying out the invention are illustrated in the drawings, in which:

FIG. 6 is a top plan view of a section of a fence system incorporating posts of the type shown in FIG. 1;

FIG. 7 is a schematic side elevation view of a die press for forming indentations in a length of metal pipe;

FIG. 8 is a schematic end-sectional view of the die press of FIG. 7;

FIG. 9 is a schematic top view of a portion of the die press of FIG. 7;

FIG. 10 is a schematic side elevation view of a power break for bending the indented length of metal pipe;

FIG. 11 is a schematic end view of the power break of FIG. 10;

DETAILED DESCRIPTION OF THE SPECIFIC EMBODIMENTS

Figure 1:
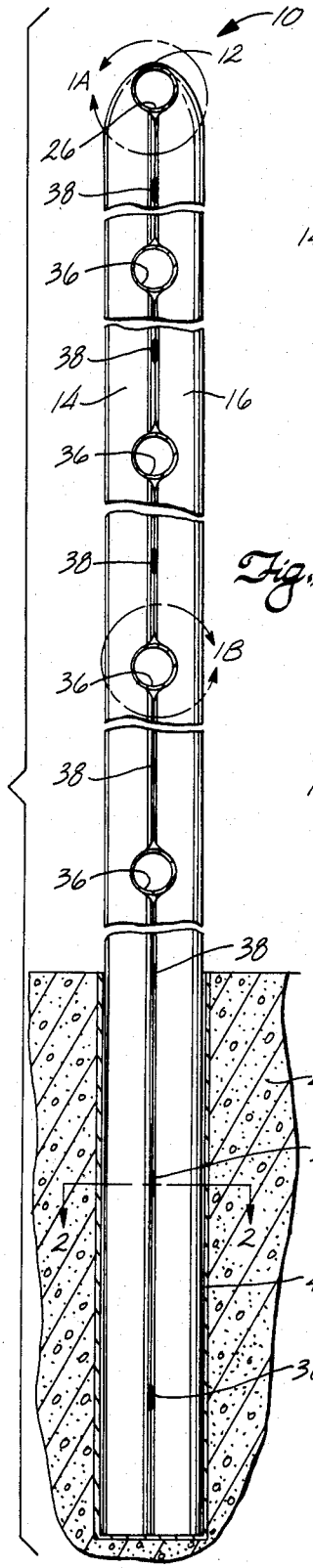
FIG. 1 is a end elevation view of a one-piece fence post incorporating the principles of the invention and FIGS. 1A and 1B are enlargements of portions of FIG. 1 without rails.
Figure 1A:
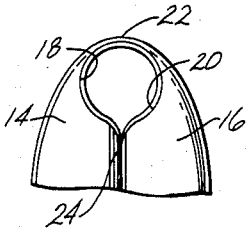
Figure 1B:
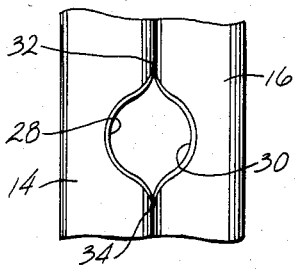
Figure 12:
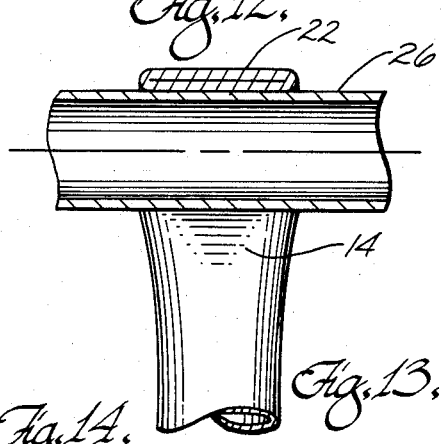
FIG. 12 is a side-sectional view of the top of the fence post of FIG. 1.
Figure 13:
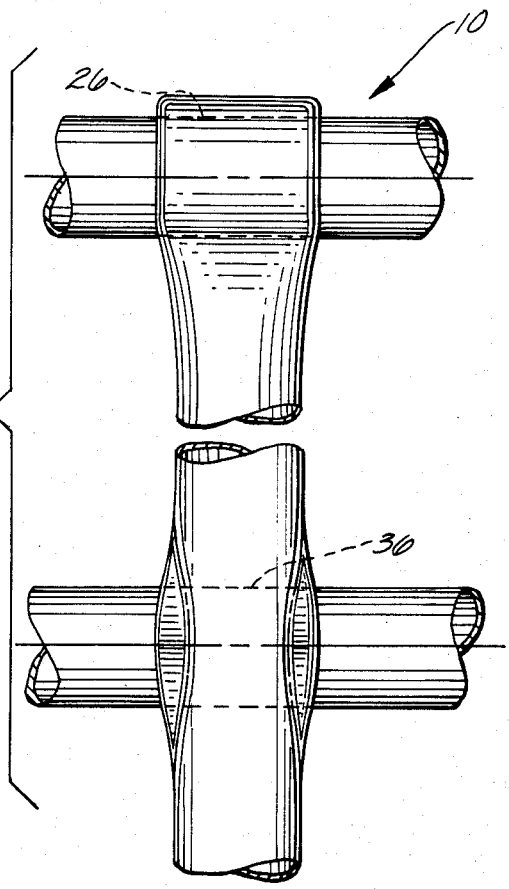
FIG. 13 is a side elevation view of part of the fence post of FIG. 1.

In FIG. 1, a vertically disposed one-piece fence post 10 is comprised of a rigid cylindrical tubular member with a circular cross section and folded in a region 12 between its ends to form longitudinally adjacent, preferably abutting portions 14 and 16 of preferably equal length. As is best illustrated in FIG. 1A, an adjacent pair of indentations 18 and 20 are formed in portions 14 and 16, respectively, in region 12 to define a transverse, i.e., horizontally extending, rail-receiving passage at the top of post 10. Indentations 18 and 20 merge together at the top of post 10 to form there a flattened tubular connection 22 between portions 14 and 16. While connection 22 has an approximately uniform cross section and a semi-cylindrical surface, the downwardly extending portions of indentations 18 and 20 have cylindrical surfaces that merge gradually into the surface of portions 14 and 16, respectively, so as to form a generally cylindrical rail-receiving passage with a cusp 24 aligned with the length of the tubular member. A horizontal tubular rail 26 with a circular cross section fits in the rail-receiving passage formed by indentations 18 and 20. As illustrated in FIG. 12, the flattened walls of connection 22 abut each other, thereby minimizing the protrusion of connection 22 above rail 26. This minimizes the chances of injury when animals are in the vicinity of rail 26. As best illustrated in FIG. 1B, at least one, but preferably a plurality of further pairs of inwardly facing adjacent indentations 28 and 30 are formed between region 12 and the ends of the tubular member to define corresponding additional transverse rail-receiving passages. Indentations 28 and 30 have cylindrical surfaces that merge gradually into the surface of the tubular member so as to form generally cylindrical rail-receiving passages with oppositely disposed cusps 32 and 34 aligned with the length of the tubular member. A horizontal tubular rail 36 with a circular cross section fits in each of the passages formed by indentations 28 and 30. As shown in FIGS. 12 and 13, the material displaced by the formation of indentations 18, 20, 28, and 30 spreads laterally to make the length of the rail-receiving passages greater than the diameter of the tubular member comprising post 10. This additional passage length improves the lateral stability of rails 26 and 36 in the fully assembled fence system. Abutting portions 14 and 16 are directly attached together at spaced apart locations along their length by welds 38. Preferably, at least one of welds 38 is disposed between each of the rail-receiving passages, as shown in FIG. 1. To attach the abutting surfaces of portions 12 and 14 mig welding or wire welding could be employed. The formation of post 10 with portions 14 and 16 abutting permits the width of the rail-receiving passages to be closely controlled and facilitates assembly of the fence system by permitting portions 14 and 16 to be directly welded together or otherwise connected. Attaching portions 14 and 16 together as by welding makes post 10 more rigid because of the multiple points of direct connection therebetween.

Figure 14:
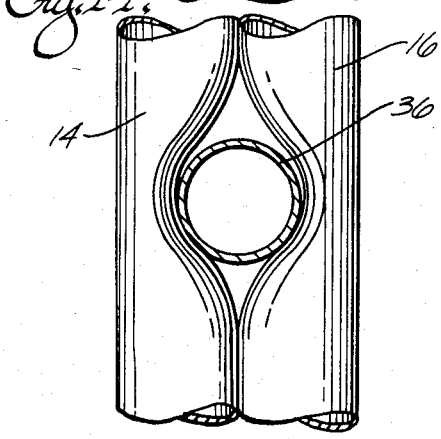
FIG. 14 is an end view of a portion of the fence post of FIG. 1 showing the clearance of one of the rails extending therethrough.

As depicted in FIG. 14 for rail 36, rails 36 and 26 have a diameter adapted to fit the diameter of the rail-receiving passages with sufficient clearance to permit adjustment of the elevation angle between the rails and the posts after installation. Typically, the diameter of rails 26 and 36 would be of the order of $\frac{1}{8}$-inch smaller than the diameter of the rail-receiving passages in a horizontal direction. As a result, it is possible to install the fence system on uneven terrain while the posts are installed in a vertical position. In other words, the clearance between the rails and the passages permits adjustment of the elevation angle of the rails during installation.

Figure 2:
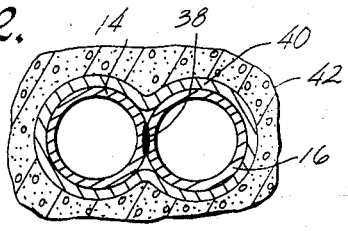
FIG. 2 is a top-sectional view of the anchored portion of the fence post of FIG. 1.

In the embodiment of FIG. 1, post 10 fits in a collar 40 anchored in the ground by a mass of concrete 42. Post 10 has a figure-8 shaped horizontal cross section; collar 40 has a similar figure-8 shaped horizontal cross section as shown in FIG. 2. Post 10 can be removed from collar 40 to disassemble the fence system. If a permanent fence system is called for, post 10 could be directly anchored in concrete mass 42.

Figure 3:
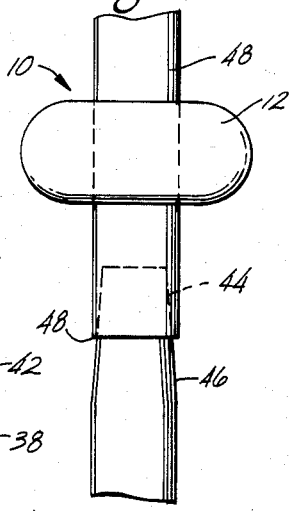
FIG. 3 is a top view of the fence post of FIG. 1 illustrating one way of connecting the horizontal rails.

The ends of each horizontal rail can be swaged out and/or down to receive the end of the rail to which it is connected. As illustrated in FIG. 3, it is preferable from the point of view of structural strength, to swage down the end 44 of one rail, designated rail 46, leaving the connecting end of the other rail, designated 48 unswaged, i.e., of the same cross-sectional area as the remainder of the rail. The end of rail 48 receiving end 44 of rail 46 passes through one pair of the indentation-formed passages and is thus supported by post 10.

Figure 4:
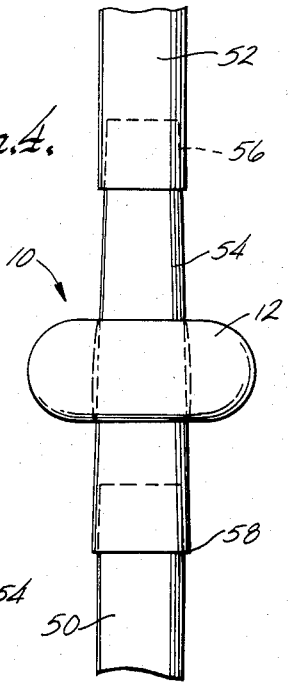
FIG. 4 is a top plan view of the fence post of FIG. 1 illustrating another way of connecting the horizontal rails.

In the embodiment of FIG. 4, horizontal rails 50 and 52 are connected by a tubular coupling sleeve 54, which fits in the indentation-formed passage and is supported by post 10. An end 56 of sleeve 54 is swaged down to fit in one end of rail 52 and an end 58 of sleeve 54 is swaged out to pass around one end of rail 50. Alternatively, instead of, or in addition to, swaging out end 58, the end of rail 50 could be swaged down, or instead of or in addition to swaging down end 56, the end of rail could be swaged out.

Figure 5:
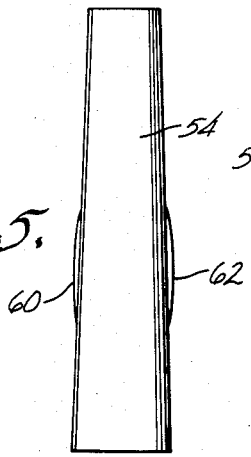
FIG. 5 is a top plan view of the coupling sleeve of FIG. 4.
Figure 15:
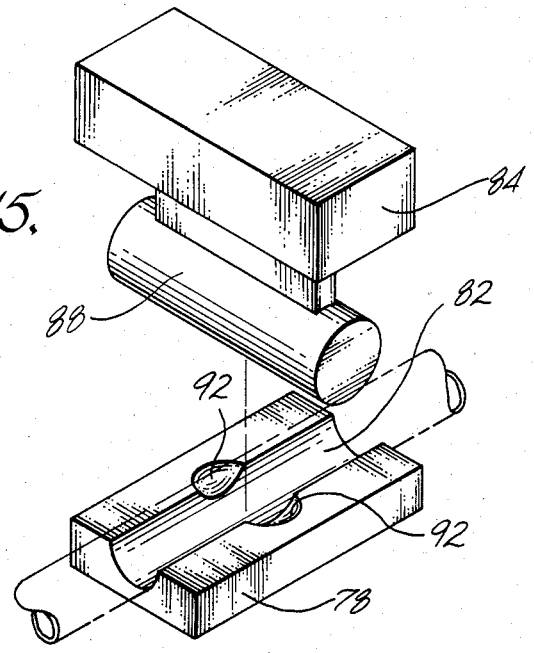
FIG. 15 is a perspective view of a portion of the die press of FIG. 7.

FIG. 5 shows the portion of sleeve 54 lying in the passage of post 10. Lugs 60 and 62 are there formed in diametrically opposite sides of sleeve 54. Sleeve 54 is inserted in an indentation-formed passage with lugs 60 and 62 aligned with the length of portions 14 and 16 so that lugs 60 and 62 clear cusps 32 and 34. Once in place, sleeve 54 is rotated, and thereby locked in place by an interference fit between lugs 60 and 62 and the cylindrical surface of the passage. (In the case of the passage formed by indentations 18 and 20, a single lug is provided.) Alternatively, lugs 60 and 62 could be formed on one end of each rail if the rails are directly connected without a coupling sleeve, as shown in FIG. 3.

In FIG. 6, posts 10*a*, 10*b*, 10*c*, and 10*d*, which are the same as post 10 in FIG. 1, together with rails 68, 69, 70, 71, and 72, form a corner of a fence system. Post 10*c*, which is at the apex of the corner, is rotated about a vertical axis at an angle of 45° to posts 10*a* and 10*b* on the one hand and post 10*d* on the other hand. Rails 70 and 71 are connected by an elbow-shaped coupling sleeve 74. Sleeve 74 and/or the ends of rails 70 and 71 are swaged in the manner described in connection with FIG. 4.

Preferably, post 10 and rails 26 and 36, 46 and 48, 50 and 52, and 68 through 71 are all made from common galvanized steel pipe, which can be worked by well-known metal-forming techniques. A pipe having an outside diameter of $1\frac{7}{8}$ inches with a 0.069 inch wall thickness is suitable. Collar 40 and sleeves 54 and 74 as well as any other parts of the fence system are also preferably made of galvanized steel.

A one-piece fence post such as post 10 is fabricated from a straight length of galvanized steel pipe stock in a three-step process. The first step is to form the indentations in a die press, as shown in FIGS. 7, 8, 9 and 14. The die press has a stationary table 76 on which a plurality of blocks 78 are mounted. A length of pipe stock, designated 80, rests in semi-cylindrical channels 82 formed in the top of blocks 78. A ram 84 moves up and down toward and away from table 76. A rectangular die 86 with curved edges is mounted on ram 84 at the middle of stock 80. Cylindrical dies 88 are mounted on ram 84 in spaced apart relationship on one side of die 86 and cylindrical dies 90 are mounted on ram 84 on the other side of die 86 in the same spaced apart relationship as dies 88. The axes of dies 86, 88, and 90 are transverse, specifically perpendicular to the axis of stock 80. The spacing between die 86 and dies 88 and 90 corresponds to the desired locations of the indentations and blocks 78 are aligned with the respective dies. Die 86 forms indentations 18 and 20, die 88 forms indentations 28, and die 90 forms indentations 30. As illustrated in FIG. 9, channels 80 of blocks 78 have bowed out regions 92 to accommodate the flattening and spreading of stock 80 where the dies form the indentations. Regions 92 control the displacement of the metal during formation of the indentations so as to spread out in the manner illustrated in FIGS. 12 and 13, and accordingly, to increase the length of the rail-receiving passages. Ram 84 is lowered toward bed 76 until dies 86, 88, and 90 permanently deform stock 80 so as to produce the indentations. At this point, the depth of the indentations formed by die 86 is the same as the depth of the indentations formed by dies 88 and 90. This depth is preferably about one-half of the thickness of the pipe. Then, ram 84 is raised to permit removal of indented stock 80.

The second step is to bend indented stock 80 in a power brake as shown in FIGS. 10 and 11. A block 94 extends from the edge of a stationary table 96. Indented stock 80 rests on block 94, which has a recess 98 under the merged indentations formed by die 86. A cylindrical work member 100 overlying recess 98 extends from a ram 102 that moves up and down away from and toward table 96. As ram 102 is lowered, work member 100 enters the merged indentation formed by die 86, thereby further deforming stock 80 at that point, driving stock 80 into recess 98, and bending stock 80 in two. This brings the two portions of stock 80 into abutment with each other, as shown in FIG. 1.

The third step, not shown in the drawings, is to weld the abutting portions of stock 80 together in a hydraulic welding fixture.

The described embodiments of the invention are only considered to be preferred and illustrative of the inventive concept; the scope of the invention is not to be restricted to such embodiments. Various and numerous other arrangements may be devised by one skilled in the art without departing from the spirit and scope of this invention. For example, the reasons for using metal pipe with a circular cross section as the tubular member are the ready availability of such pipe stock and the ease of fabricating fence posts therefrom according to the principles of the invention. In its broadest aspects, the invention also contemplates use of plastic as the tubular member and/or rails and, a tubular member and/or rail having a noncircular, e.g., square, cross section. Similarly, the use of generally cylindrical rail-receiving passages with oppositely disposed cusps is also dictated by the ease of formation of such passages. Other shapes are contemplated within the broadest aspects of the invention.

What is claimed is:

1. A one-piece fence post comprised of a rigid tubular member folded in a region between its ends to form first and second longitudinally abutting portions, a first pair of inwardly facing adjacent indentations formed in the respective first and second portions in the folded region to define a first transverse rail-receiving passage, a second pair of inwardly facing adjacent indentations formed in the respective first and second portions between the folded region and the ends of the member to define a second transverse rail-receiving passage, and means for directly attaching the first and second abutting portions together.

2. The fence post of claim 1, in which the tubular member is made of metal.

3. The fence post of claim 2, in which the tubular member has a circular cross section.

4. The fence post of claim 3, in which the first rail-receiving passage is generally cylindrical with a cusp facing away from the folded region and aligned with the length of the tubular member.

5. The fence post of claim 4, in which the tubular member is flattened in the folded region.

6. The fence post of claim 5, in which the second rail-receiving passage is generally cylindrical with oppositely disposed cusps aligned with the length of the tubular member.

7. The fence post of claim 6, in which the joining means comprises a plurality of weld joints distributed along the length of the first and second portions.

8. The fence post of claim 7, in which at least one weld joint is disposed between the passages.

9. The fence post of claim 1, additionally comprised of a third pair of inwardly facing adjacent indentations formed in the respective first and second portions between the second pair of indentations and the ends of the member to define a third transverse rail-receiving passage.

10. The fence post of claim 9, in which the joining means comprises a plurality of weld joints at least one of which is disposed between each pair of passages.

11. A fence system comprising:

a one-piece fence post comprised of a rigid tubular member folded in a region between its ends to form first and second longitudinally abutting portions, a first pair of inwardly facing adjacent indentations formed in the respective first and second portions in the folded region to define a first transverse rail-receiving passage, a second pair of inwardly facing adjacent indentations formed in the respective first and second portions between the folded region and the ends of the member to define a second transverse rail-receiving passage, and means for joining the first and second portions together; and a plurality of rails adapted to fit in the respective passages.

12. The fence system of claim 11, in which the rails are tubular and the tubular member and the rails each have a circular cross section.

13. The fence system of claim 12, additionally comprising a coupling sleeve adapted to connect the rails.

14. The fence system of claim 11, additionally comprising an anchoring collar adapted to fit around the ends of the fence post.

15. The fence system of claim 11, additionally comprising a tubular coupling sleeve adapted to connect the rails.

16. The fence system of claim 15, in which one end of the coupling sleeve fits in one end of a rail and the other end of the coupling sleeve fits around one end of a rail.

17. The fence system of claim 16, in which the second passage is generally cylindrical with oppositely disposed cusps aligned with the length of the tubular member.

18. The fence system of claim 17, in which the coupling sleeve has oppositely disposed lugs that fit into the second rail-receiving passage aligned with the cusps and lock in place by interference fit when twisted away from the cusps.

19. The fence system of claim 11, in which the second passage is generally cylindrical with oppositely disposed cusps aligned with the length of the tubular member.

20. The fence system of claim 19, in which the rail has oppositely disposed lugs that fit into the second rail-receiving passage aligned with the cusps and lock in place by interference fit when twisted away from the cusps.

21. The fence system of claim 11, in which two of the rails lie transverse to each other additionally comprising a tubular elbow adapted to form a corner that receives the ends of the transverse rails.

22. The fence system of claim 11, additionally comprising means for anchoring the ends of the tubular member.

23. The fence system of claim 14, additionally comprising means for anchoring the collar.

24. A method for fabricating a one-piece fence post comprising the steps of:

placing in a die press having a centrally located rectangular die with curved edges and a plurality of pairs of cylindrical dies distributed on both sides of the rectangular die a length of rigid permanently deformable metal pipe;

closing the press to permanently deform the pipe, thereby forming indentations corresponding to the respective dies;

folding the indented pipe in two about the indentation corresponding to the rectangular die, thereby forming two abutting portions connected by a folded region, a rail-receiving passage corresponding to the rectangular die, and one or more rail-receiving passages corresponding to the respective pairs of cylindrical dies; and welding the abutting portions of the pipe at a plurality of locations along their length.

25. The method of claim 24, in which the folding step comprises placing the indented pipe in a power brake having a cylindrical work piece and driving the cylindrical work piece into the indentation formed by the rectangular die to deform the pipe further, thereby pivoting the portions of the pipe on either side of said indentation together.

26. The fence post of claim 1, in which the tubular member is cylindrical and has a given diameter and the rail-receiving passages have a length greater than the given diameter.

27. The fence post of claim 1, having flattened, abutting walls in the folded region.

28. A one-piece fence post comprised of a rigid cylindrical tubular member having a given diameter folded in a region between its ends to form first and second longitudinally adjacent portions, a first pair of inwardly facing adjacent indentations formed in the respective first and second portions in the folded region to define a first transverse rail-receiving passage having a length greater than the given diameter, a second pair of inwardly facing adjacent indentations formed in the respective first and second portions between the folded region and the ends of the member to define a second transverse rail-receiving passage having a length greater than the given diameter, and means for joining the first and second portions together.

29. The fence post of claim 28, having flattened, abutting walls in the folded region.

30. A one-piece fence post comprised of a rigid tubular member folded in a region between its ends to form first and second longitudinally adjacent portions and flattened abutting walls in the folded region, a first pair of inwardly facing adjacent indentations formed in the respective first and second portions in the folded region to define a first transverse rail-receiving passage, a second pair of inwardly facing adjacent indentations formed in the respective first and second portions between the folded region and the ends of the member to define a second transverse rail-receiving passage, and means for joining the first and second portions together.

31. A fence system comprising:

a one-piece fence post comprised of a rigid tubular member folded in a region between its ends to form first and second longitudinally adjacent portions, a first pair of inwardly facing adjacent indentations formed in the respective first and second portions in the folded region to define a first transverse rail-receiving passage having a generally cylindrical shape with a given diameter and a cusp aligned the length of the tubular member, a second pair of inwardly facing adjacent indentations formed in the respective first and second portions between the folded region and the ends of the member to define a second transverse rail-receiving passage having a generally cylindrical shape with the given diameter and oppositely disposed cusps aligned the length of the tubular member, and means for joining the first and second portions together; and a plurality of cylindrical rails having a diameter adapted to fit the given diameter of the respective passages with sufficient clearance to permit adjustment of the angle between the post and the rails.

32. The fence system of claim 31, in which the first and second portions are longitudinally abutting and the joining means comprises means for directly connecting the first and second portions together.

33. The fence system of claim 31, in which the post has flattened, abutting walls in the folded region.

34. The fence system of claim 31, in which the tubular member is cylindrical and has a predetermined diameter and the rail-receiving passages have a length greater than the predetermined diameter of the tubular member.

35. The method of claim 24 in which the closing step displaces the material caused by deformation in a sideways direction to increase the length of the rail-receiving passages.

* * * * *